US008313352B2

(12) United States Patent
Yu

(10) Patent No.: US 8,313,352 B2
(45) Date of Patent: Nov. 20, 2012

(54) TERMINAL ASSEMBLY

(76) Inventor: Tsung Mou Yu, Panchiao (TW)

( * ) Notice: Subject to any disclaimer, the term of this patent is extended or adjusted under 35 U.S.C. 154(b) by 231 days.

(21) Appl. No.: 12/894,125

(22) Filed: Sep. 29, 2010

(65) Prior Publication Data

US 2012/0073946 A1 Mar. 29, 2012

(51) Int. Cl.
*H01R 13/40* (2006.01)

(52) U.S. Cl. ..... 439/733.1; 439/596

(58) Field of Classification Search ..... 439/733.1, 439/696, 596, 752.5
See application file for complete search history.

(56) References Cited

U.S. PATENT DOCUMENTS 2,398,996 A * 4/1946 Benander ..... 439/696
2,476,738 A * 7/1949 Klumpp, Jr. ..... 439/866
3,783,438 A * 1/1974 Grant ..... 439/696
4,317,609 A * 3/1982 Lapraik ..... 439/733.1
5,403,215 A * 4/1995 Buchter et al. ..... 439/869
5,626,499 A * 5/1997 Yagi et al. ..... 439/752.5
5,938,456 A * 8/1999 Kozel et al. ..... 439/83
6,146,200 A * 11/2000 Ito et al. ..... 439/596
6,244,900 B1 * 6/2001 Ishikawa et al. ..... 439/595
6,572,417 B2 * 6/2003 Katsuma ..... 439/752.5
7,635,286 B1 * 12/2009 Morello ..... 439/752.5
7,914,327 B2 * 3/2011 Campbell et al. ..... 439/595
2004/0192119 A1 * 9/2004 Sakurai et al. ..... 439/752.5

* cited by examiner

*Primary Examiner* — Gary F. Paumen
(74) *Attorney, Agent, or Firm* — Lin & Associates IP, Inc.

(57) ABSTRACT

A terminal assembly for a switch device includes a hollow case, two terminals, two slots respectively corresponding to the terminals and a contact piece. The terminal includes a curved portion and the slot includes a curved slot corresponding to the curved portion. The case has a protrusion disposed corresponding to the curved slot. When assembling the terminal with the case, the terminal is received in the slot, the curved portion is engaged with the curved slot and the protrusion is pressed against a concave side of the curved portion. Therefore, the terminal is securely connected with the case and the terminal does not move or get loosened during use.

2 Claims, 4 Drawing Sheets

TERMINAL ASSEMBLY

BACKGROUND OF THE INVENTION

1. Field of the Invention

The present invention relates generally to a terminal assembly for a switch device, and in particular to a terminal for a terminal assembly that has a curved portion to be engaged with a curved slot of a case so as to firmly connect the terminal with the case.

2. The Prior Arts

A conventional switch device generally includes two terminals protruding out of a case thereof and the two terminals are connected to a circuit. Because most of the terminals are exposed out of the case, top ends of the terminals are bent, usually a 90-degree bent, so as to securely assemble the terminals in the case. Furthermore, the case has two slots corresponding to the terminals. The terminals are engaged in the slots, which also firmly connect the terminals with the case.

The length of the terminal is generally ranged between 15-20 mm, the width of the terminal is ranged between 3-5 mm and the thickness of the terminal is generally 1 mm. Because the terminal is small, it is difficult to hold the terminals and difficult to assemble the terminals with the case. Moreover, in order to prevent the terminals from moving or slipping in the case, the case includes stop plates disposed corresponding to top ends of the terminals to further secure the terminals. However, the stop plates occupy extra space of the case and make the structure of the case more complicated. Therefore, it is more difficult to make molds for manufacturing the case, which make the cost higher.

SUMMARY OF THE INVENTION

A primary objective of the present invention is to provide a terminal assembly, which overcomes the disadvantages of the conventional design that is difficult to assemble, requires stop plates to prevent terminals from slipping and moving, lacks of space in the case and needs complicated molds.

In order to achieve the objective, a terminal assembly according to the present invention includes a terminal having a curved portion to be engaged with a curved slot in a case. The case further includes a protrusion to engage with the curved portion of the terminal, thereby securely connecting the terminal with the case and preventing the terminal from loosening and moving.

Because the curved portion of the terminal is engaged with the curved slot of the case, the terminal assembly does not need stop plates on tops of the terminals to secure the terminals. Therefore, the structure of the case is simplified and inner space of the case is increased. Moreover, the cost of the material is reduced and it is easier to assemble the terminal assembly.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
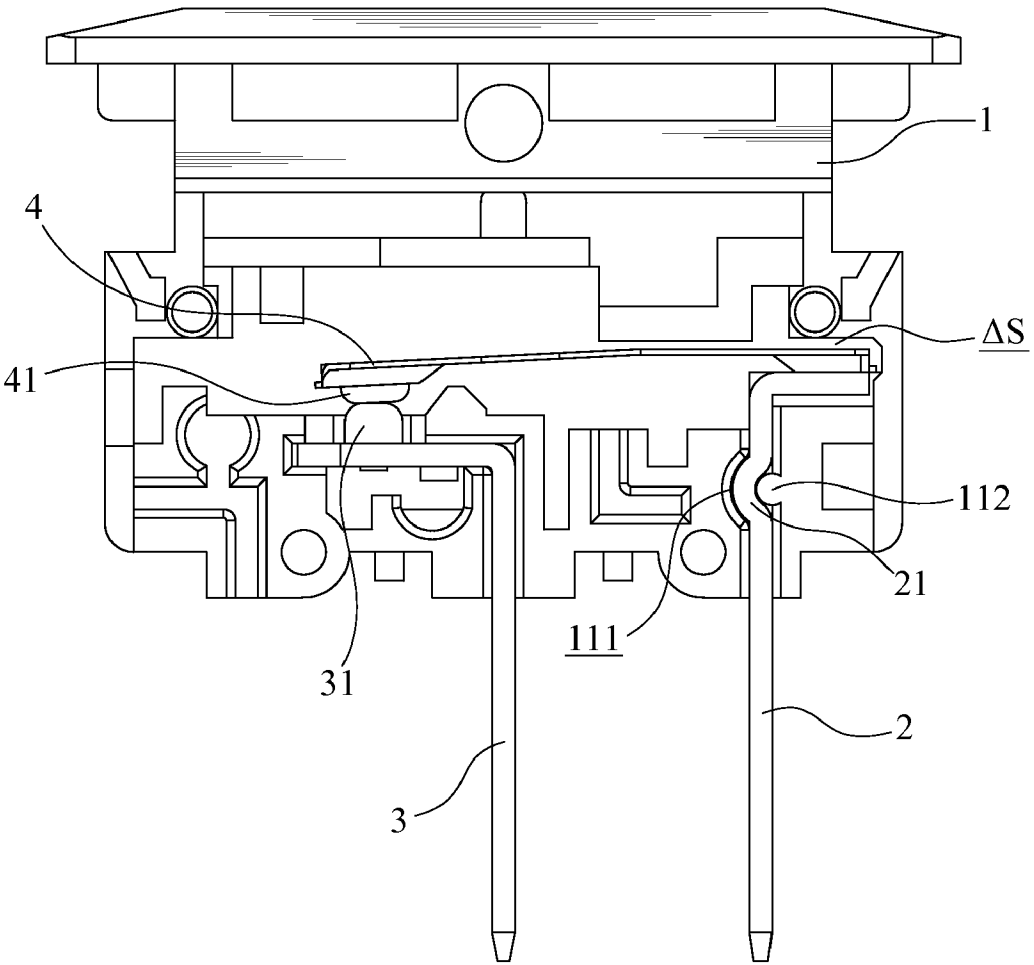
FIG. 1 is a cross sectional view showing a terminal assembly in accordance with the present invention, which is in an "ON" state.

With reference to FIGS. 1 to 4, a terminal assembly according to the present invention is used in a switch device and comprises a hollow case 1, a first terminal 2, a second terminal 3 and a contact piece 4.

The case 1 includes a first slot 11 and a second slot 12 defined through a bottom thereof.

The first terminal 2 and the second terminal 3 are in L-shaped and engaged with the first slot 11 the second slot 12, respectively. Bottom ends of the first terminal 2 and the second terminal 3 extend out of the case 1. A second contact point 31 is connected to the top end of the second terminal 3.

Figure 4:
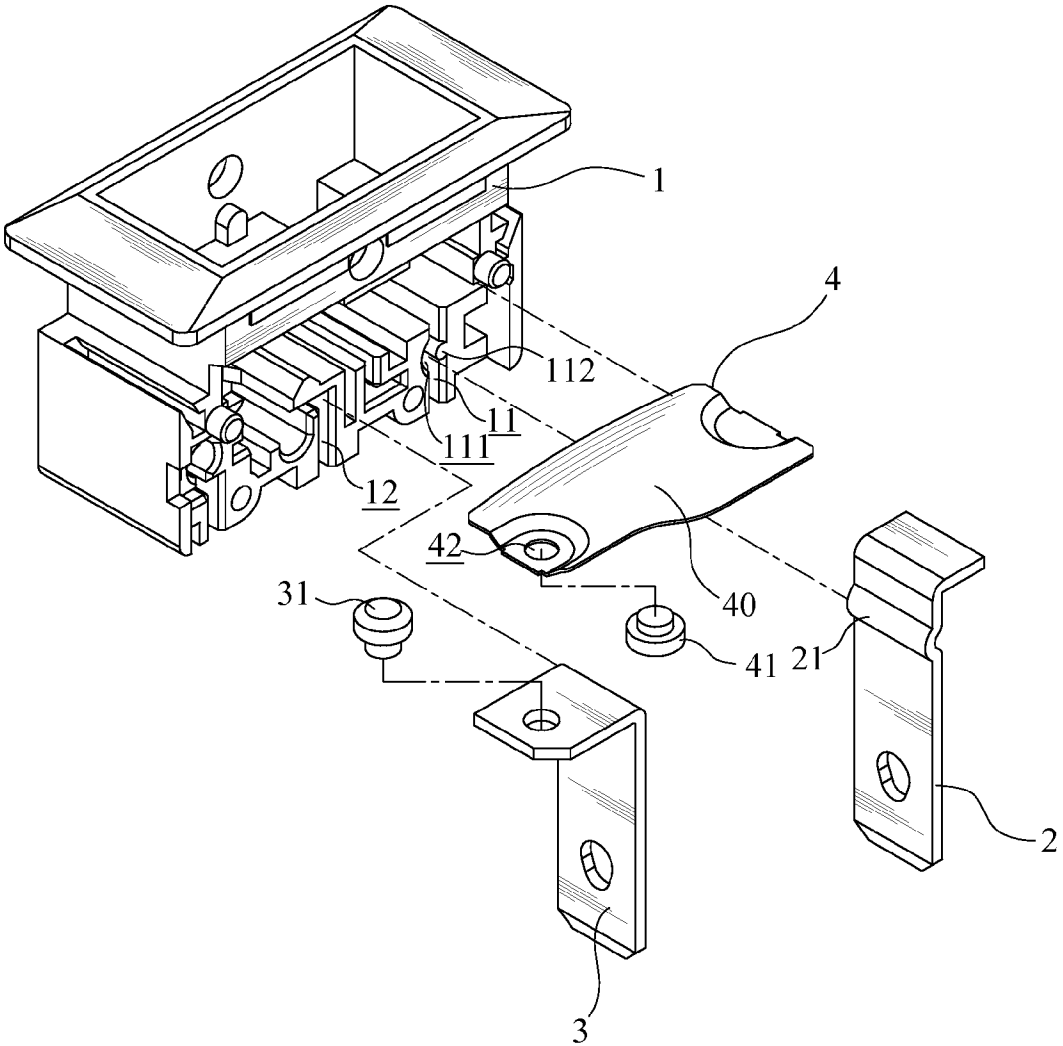
FIG. 4 is an exploded view showing the terminal assembly in accordance with the present invention.

The contact piece 4 is a strip which is used to connect or disconnect the first terminal 2 and the second terminal 3. The contact piece 4 may be an alloy strip and has a bent portion 40 as shown in FIG. 4. The bent portion 40 allows the contact piece 4 to bend toward one side thereof and the contact piece 4 bends toward the other side thereof when being overheated. The contact piece 4 has a fixed end connected to the top end of the first terminal 2 by way of welding or riveting. A fee end of the contact piece 4 has a hole 42 to which a first contact point 41 is connected. The first contact point 41 is movably located above the second contact point 31 of the second terminal 3

Generally, the case 1 has a button (not shown) and the button is operatively connected to the free end of the contact piece 4.

In operation, the button is pushed to force the free end of the contact piece 4 to bend downward. Due to the bent portion 40, the contact piece 4 keeps to be bent downward and the first contact point 41 contacts with the second contact point 31. Therefore, the circuit is in an "ON" state as shown in FIG. 1.

Figure 2:
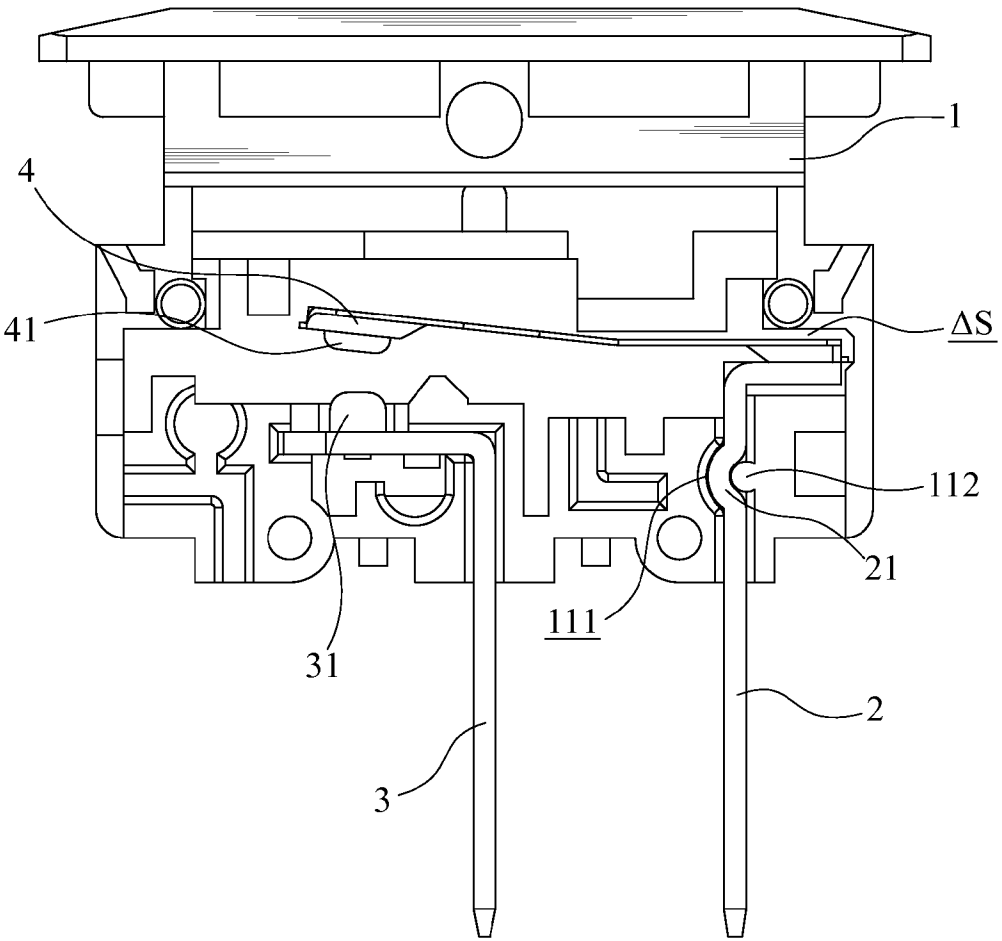
FIG. 2 is a cross sectional view showing the terminal assembly in accordance with the present invention, which is in an "OFF" state.
Figure 3:
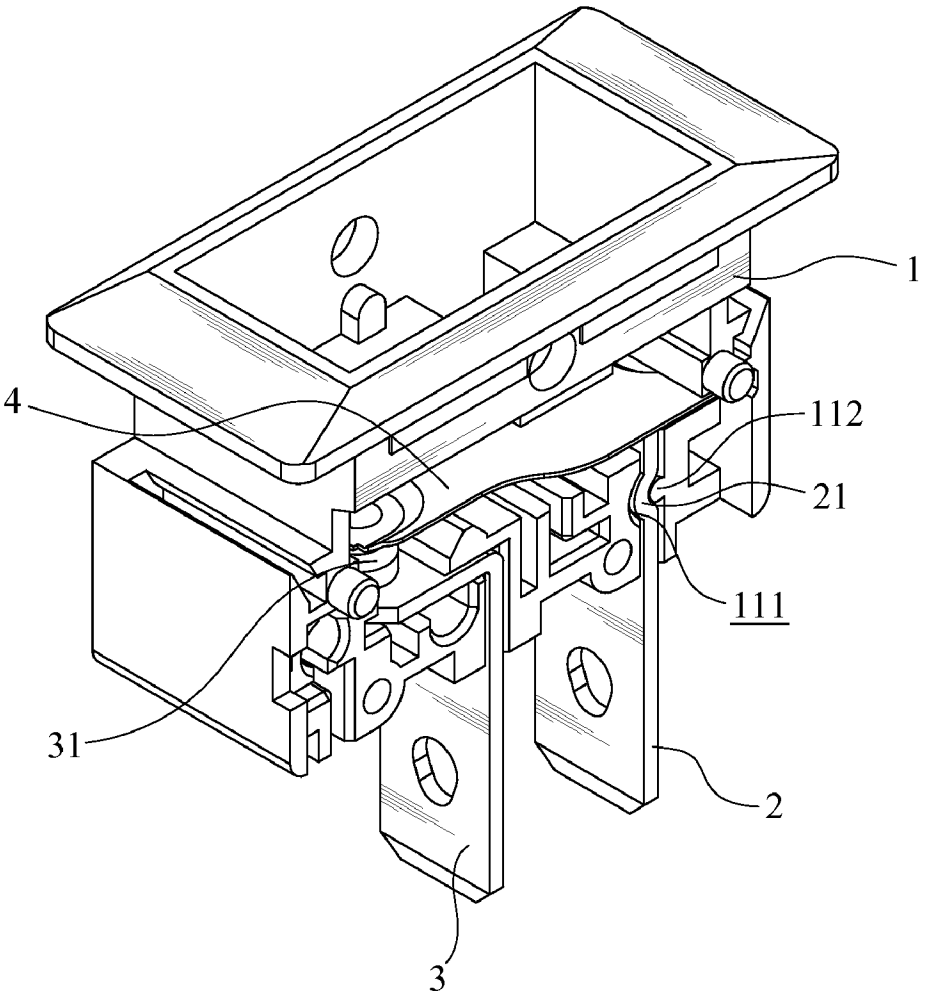
FIG. 3 is a perspective view showing the terminal assembly in accordance with the present invention.

Alternatively, the button is pushed to force the free end of the contact piece 4 to bend upward. Due to the bent portion 40, the contact piece 4 keeps to be bent upward and the first contact point 41 is separated from the second contact point 31. Therefore, the circuit is in an "OFF" state as shown in FIG. 2.

When the circuit is in the "ON" state as shown in FIG. 1, the electric current is excessive and the contact piece 4 is overheated, the contact piece 4 is deformed and bent upward. The bent portion 40 bends upward and the free end of the contact piece 4 moves upward to separate the first contact point 41 from the second contact point 31. Thus, the circuit becomes the "OFF" state as shown in FIG. 2.

After the overheat problem is removed, the button is pushed again so that the free end of the contact piece 4 bends downward. The first contact point 41 and the second contact point 31 are in contact with each other again. The circuit is in the "ON" state as shown in FIG. 1.

The practical action and operation status are similar to the conventional switch device.

The characteristics of the present invention are described as follows. According to the present invention, the first terminal 2 has a curved portion 21 and the curved slot 11 has a curved slot 111 corresponding to the curved portion 21. A protrusion 112 is disposed corresponding to the curved slot 111 of the case 1. When the first terminal 2 is received in the first slot 11, the protrusion 112 is pressed against a concave side of the curved portion 21 of the first terminal 2. Due to the engagement between the protrusion 112 and the curved portion 21, the first terminal 2 is securely connected to the case 1.

Referring to FIGS. 1 and 2, the top end of the first terminal 2 is connected to the contact piece 4. The connection point of the contact piece 4 and the first terminal 2 is not in contact with the case 1 and a gap ΔS is defined between the case 1 and the connection point of the contact piece 4. Because the curved slot 111 is engaged with the curved portion 21, the first terminal 2 is firmly connected to the case 1. Thus, the first terminal 2 does not move upward or downward relative to the case 1 and does not get loosened from the case 1. Also, the gap ΔS provides a space for the deformation of the contact piece 4. When the contact piece 4 bends upward or downward, the contact piece 4 does not contact with the case 1.

The second terminal 3 can also be designed as the first terminal 2 to have a curved portion and the case 1 has a curved slot corresponding to the curved portion of the terminal 3, thereby engaging the curved portion of the second terminal 3 with the curved slot of the case. A protrusion is also located corresponding to the curved slot and engaged with the concave side of the curved portion of the second terminal 3 to firmly connect the second terminal 3 with the case 1.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A terminal assembly, comprising:

a hollow case having two slots;

two terminals respectively engaged with the slots, each of the terminals having an end extending out of the case; and a contact piece capable of connecting or disconnecting the two terminals;

wherein at least one of the terminals includes a curved portion, at least one of the slots of the case forms a curved slot corresponding to the curved portion, the curved portion is engaged with the curved slot, the case comprises a protrusion disposed corresponding to the curved slot and the protrusion is pressed against a concave side of the curved portion, thereby securely connecting the at least one terminal with the case.

2. The terminal assembly as claimed in claim 1, wherein the contact piece is a strip.

* * * * *